US006889609B2

(12) United States Patent
Braun et al.

(10) Patent No.: US 6,889,609 B2
(45) Date of Patent: May 10, 2005

(54) METHOD AND DEVICE FOR GENERATING AN AIR STREAM IN A DUPLICATING MACHINE

(75) Inventors: Helmut Braun, Rauenberg (DE); Bernd Heller, Neckargemünd (DE); Thomas Wolf, Karlsruhe (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 24 days.

(21) Appl. No.: 09/927,555

(22) Filed: Aug. 9, 2001

(65) Prior Publication Data

US 2002/0060407 A1 May 23, 2002

(30) Foreign Application Priority Data

Aug. 9, 2000 (DE) ..... 100 38 774

(51) Int. Cl.[7] ..... B41M 00/00
(52) U.S. Cl. ..... 101/483; 101/424.1
(58) Field of Search ..... 101/424.1, 424.2, 101/416.1, 483, 488, 487; 271/211, 208; 315/111.91

(56) References Cited

U.S. PATENT DOCUMENTS

| | | | | |
|---|---|---|---|---|
| 3,751,715 A | * | 8/1973 | Edwards | 361/230 |
| 4,210,847 A | | 7/1980 | Shannon et al. | 315/111.91 |
| 4,463,363 A | * | 7/1984 | Gundlach et al. | 347/125 |
| 4,524,371 A | * | 6/1985 | Sheridon et al. | 347/125 |
| 4,593,994 A | * | 6/1986 | Tamura et al. | 399/135 |
| 4,643,414 A | | 2/1987 | Weisgerber | 315/111.91 |
| 5,006,761 A | | 4/1991 | Török et al. | 315/111.91 |
| 5,153,618 A | * | 10/1992 | Frank et al. | 347/125 |
| 5,497,987 A | | 3/1996 | Henn et al. | 271/204 |
| 6,038,998 A | | 3/2000 | Platsch | 118/46 |

FOREIGN PATENT DOCUMENTS

| | | |
|---|---|---|
| DE | 1 286 051 | 1/1969 |
| DE | 24 46 798 | 4/1978 |
| DE | 34 13 179 C2 | 10/1985 |
| DE | 43 08 276 A1 | 9/1994 |
| DE | 197 33 691 A1 | 6/1998 |
| GB | 1085743 | 10/1967 |
| WO | PCT/EP99/04864 | 2/2000 |

* cited by examiner

*Primary Examiner*—Anthony H. Nguyen
(74) *Attorney, Agent, or Firm*—Laurence A. Greenberg; Werner H. Stemer; Gregory L. Mayback

(57) ABSTRACT

A device for generating an air stream in a duplicating machine, in particular in a printing machine, has at least one fan unit, which includes at least one ionic fan. Methods for guiding and depositing flat products, in particular print carriers, in duplicating machines are also provided. Further, a method for the zonal powdering of print carriers in duplicating machines is provided. A delivery configuration, in particular for printing machines, is also provided.

31 Claims, 5 Drawing Sheets

METHOD AND DEVICE FOR GENERATING AN AIR STREAM IN A DUPLICATING MACHINE

BACKGROUND OF THE INVENTION

Field of the Invention

The invention relates to a device for generating an air stream in a duplicating machine, in particular in a printing machine. The invention relates, furthermore, to methods for guiding and depositing flat products, in particular print carriers, in duplicating machines. The invention also relates to a method for the zonal powdering of print carriers in duplicating machines. The invention also relates to a delivery configuration and to a method of guiding and/or transporting flat products.

It is known, in duplicating machines, for example in printing machines, which process sheetlike or weblike flat products, in particular print carriers, to assist the transport of the flat products through the use of an air stream.

In this way, for example, in rotary printing machines paper sheets are guided by transport grippers at a front edge of the sheets and, in addition, their trailing sheet surface is supported by an air cushion. Thus a situation can be prevented where the sheet touches components of the printing machine and is damaged or where smudging of the freshly printed-on printing ink occurs.

Such a guide device for a sheet with an air flow between the sheet and a sheet guide surface is known from Published, Non-Prosecuted German Patent Application No. DE 43 08 276 A1 corresponding to U.S. Pat. No. 5,497,987. A respective sheet is exposed to an air flow generated through the use of a plurality of air jets which emerge from flow ducts provided in the sheet guide surface, the flow ducts having the form of perforations at the sheet guide surface. These perforations are provided with blowing nozzles which are connected to a compressed-air source via blowing-air lines, and, where appropriate, the blowing-air lines can be opened and closed individually or in functional groups through the use of adjustable valves.

A guide device of the type described above has the disadvantage that it is not possible to set the air flow accurately, since the strength of the individual air jets cannot be regulated in a continuous manner. Moreover, in order to modify the generated flow profile, it would be necessary to exchange the guide device for a second guide device having a modified nozzle configuration.

Further, fans may be used in deliveries of printing machines. Through the use of such fans, the printed sheets, which are released by the transport grippers, are pressed downward onto a depositing pile. German Patent No. DE 34 13 179 C2, corresponding to U.S. Pat. No. 4,643,414, describes a control and regulating device of a sheet delivery for sheet-processing machines. In this case, the sheets are supported, during depositing, by an air flow which is caused by blowing fans provided above the transport path of the sheets. The fans may be driven individually, in longitudinal or transverse rows, in a diagonal row or in any combination at a higher or lower rotational speed or else switched off completely.

However, since the fans have very large dimensions, only a small number can be provided adjacently to the sheet transport path, and therefore it is not possible to generate a desired flow field with a high degree of inaccuracy.

Furthermore, blower units are also used during the powdering of freshly printed sheets in the delivery of a printing machine. Published, Non-Prosecuted German Patent Application No. DE 197 33 691 A1, corresponding to U.S. Pat. No. 6,038,998, shows a sheet-processing rotary printing machine, in which the sheets are guided over an air cushion. In this case, above the transport path, powder nozzles are provided, through the use of which the powder is applied to the sheets in an air/powder mixture. Powder nozzles which are acted upon by powdering gas may also be provided in guide plates provided below the sheet transport path.

In the described device for the powdering of sheets, undesirable turbulences of the air/powder mixture may occur, with the result that the powder settles on components of the printing machine, so that these have to be cleaned regularly. Accurate zonal powder application is not possible with the aid of the device described.

Moreover, the prior art, such as, for example, U.S. Pat. No. 5,006,761 and U.S. Pat. No. 4,210,847, discloses fans which, instead of using a rotating propeller, utilize the phenomenon of electrical discharge. U.S. Pat. No. 4,210,847 shows a fan element having an outer cylindrical nonconductive housing, at one end of which a grounded grid is mounted, while a wire applied to a voltage is provided at the other end. When a voltage of up to 20 kV is applied, discharge takes place at the front uninsulated end of the wire, thus generating, in the vicinity of the wire, ions which are accelerated toward the grounded grid due to the prevailing electrical field. By pulse transmission, even noncharged air molecules are accelerated in the direction of the grid aperture of the fan element, with the result that an air stream of up to 500 ft./min (about 15 m/min) is obtained. Such a fan element is distinguished by a high degree of reliability, along with a simple configuration and a low weight, and by an air stream which can be controlled by the applied voltage.

U.S. Pat. No. 5,006,761 describes a similar device for generating an air stream, which, in addition to preventing point discharges and reducing the production of toxic gases due to the discharges, provides an essentially spherical body which is attached to the tip of the discharge wire, with the result that a discharge takes place uniformly on the outer surface of the discharge wire.

Moreover, a German company named ETR-GmbH in Dortmund, Germany has developed a fan which likewise utilizes the acceleration of charged air molecules between a discharge electrode and a target electrode for flow generation and which reaches flow velocities of up to 3 m/s. It is also proposed to combine individual fans into fan configurations, for example as a planar checkered configuration, in order thereby to increase the flow cross section. In the case of a cross-sectional area of 1 $m^2$, a volume flow of 11,000 $m^3$/h can be generated through the use of the fans described.

SUMMARY OF THE INVENTION

It is accordingly an object of the invention to provide a device for generating an air stream in a duplicating machine which overcomes the above-mentioned disadvantages of the heretofore-known devices of this general type and which has a simple and maintenance-free construction and which makes it possible to control the strength of the air stream accurately and simply.

It is accordingly another object of the invention to provide methods for guiding and depositing flat products in duplicating machines, in which methods flow fields are generated, the local strength of which can be controlled accurately and in a simple manner.

An object of the present invention is, furthermore, to provide a method for the zonal powdering of print carriers in duplicating machines, in which method a flow field is generated, the local strength of which can be controlled accurately and simply.

With the objects of the invention in view there is provided, in combination with a duplicating machine, a device for generating an air stream in the duplicating machine, including:

at least one fan unit for generating the air stream; and the at least one fan unit having at least one ionic fan.

In other words, the device according to the invention for generating an air stream in a duplicating machine, in particular in a printing machine, which has at least one fan unit, is distinguished in that the at least one fan unit includes at least one ionic fan.

The device according to the invention allows the printer to control the air stream accurately by the supply of voltage to the ionic fan. Furthermore, with the accuracy of the control of the air stream being maintained, the dimensions of the ionic fan can be reduced appreciably, as compared with conventional propeller fans, with the result that, according to the invention, the printer achieves a saving of space in the duplicating machine by the use of one or more ionic fans. It is possible, moreover, to provide the electrodes of the at least one ionic fan on a carrier, with the result that such a configuration, for example planar, of the electrodes can be reduced in dimensions down to the microstructure range through the use of known cost-effective production processes. The use of ionic fans also leads advantageously to a reduction in the noise level and to wear-free operation, since moved parts, such as, for example, the propellers, are dispensed with and there is consequently also no need to keep these in stock. The latter aspect results, as compared with known fans, in a markedly increased useful life.

In a further refinement of the device according to the invention, the at least one fan unit may include a number of ionic fans provided essentially adjacent to one another so as to follow a space curve, in particular so as to follow a straight line. It is thereby possible, according to the invention, to set up and provide, for example, rows of ionic fans transversely, parallel or in any desired orientation to the direction of transport of flat products in the duplicating machine. Furthermore, due to the compact form of construction, even curved configurations of ionic fans can be produced, which, for example, can be adapted to the contour of a printing-unit cylinder in a printing machine and be provided in the vicinity of the cylinder. A further version according to the invention may include a suction strip or a blowing strip at points of transfer of flat products, for example sheets, from one transport system to a following transport system, for example from one transport cylinder to the next, the strips assisting the transfer of products, for example in order to prevent damage to the products.

It is also possible, moreover, for the at least one fan unit of the device according to the invention to include a number of ionic fans provided essentially adjacently to one another and distributed over a given area, in particular over a level or planar area. For example, a matrix of ionic fans can thereby be set up in the simplest possible way, in which the ionic fans are provided next to one another in a check-board configuration or a honeycomb configuration, and such an ionic-fan matrix can be provided preferably in the vicinity of the transport path of flat products in a duplicating machine and act upon the flat products such print carriers through the use of an air stream. It is also possible to provide such a matrix of ionic fans with any desired curvature in space, in order, for example, to integrate it into the meandering transport path of print carrier sheets in a sheet-fed rotary printing machine.

According to another feature of the invention, the electrodes of individual ionic fans may be provided on printed circuit boards and thus very many and very small ionic fans may be provided in a confined space. A circular target electrode, as an example, can have a diameter of 100 $\mu$m and be provided at a distance of a few centimeters from adjacent target electrodes. Such fan assemblies can be used preferably in copiers.

In a way according to the invention, the number of ionic fans can be controlled individually in order to generate a desired flow field, that is to say each individual ionic fan generates a desired flow, so that the superposition of the individual flows produces a desired flow field. Such a flow field may, in this case, have any desired contour, for example the flow strength may decrease toward the edge regions transversely to the direction of transport of a flat product in a duplicating machine.

It is possible, moreover, during the transport of flat products, to support their trailing free end through the use of a specifically set flow field during transport, in such a way that flapping of the tailing end is reduced or is suppressed essentially completely. Thus, for example, known detection devices may be used for determining the position of the free end of a flat product in space and the local strength of the flow field may be modified, for example via a regulating device, in such a way that this position is approximated or brought closer to a desired position of the free end of a flat product. It is also possible, by a presence detection devices, to determine whether a flat product is located in the vicinity of one or more ionic fans, and, in the absence of the flat product, at least to reduce the output of the respective ionic fans. Furthermore, it is possible to switch off individual ionic fans of the fan configuration, which, for example during the processing of small-format flat products, generate an air stream outside the region of the flat products. In this case, for example, optical or acoustic, in particular ultrasonic single-point sensing methods and devices or else methods operating over a large area, using stereoscopy or strip projection, may be employed for sheet position detection.

According to the invention, the air streams of individual ionic fans may also have different directions. This may take place, for example, as a result of the mechanical orientation of the individual fans or else, preferably, in that the target electrodes of the fans are set up in such a way that they can be activated in a segmented manner. Thus, for example, the annular target electrode of a fan may be subdivided into four segments which can be individually provided with a voltage, with the result that the ionic current is deflected or guided from the discharge electrode to the target electrode segment provided with voltage and therefore leaves the ionic fan in a variably controllable direction.

A device according to the invention may be distinguished, furthermore, in that the at least one fan unit is provided adjacent to a transport path of flat products, in particular of print carriers, for example paper sheets or board sheets. By virtue of the configuration according to the invention adjacent to the transport path, it advantageously becomes possible favorably to influence or guidingly to support or assist the transport of the flat products through the use of the air flow generated by the fan unit. Thus, for example, a large-area configuration of ionic fans may be used, instead of a conventional sheet guide plate, for guiding print carrier sheets in a machine processing print carrier sheets, with the result that a stabilized transport of the print carrier sheets is achieved and smudging of freshly printed-on printing ink at the guide device can advantageously be prevented. At the same time, according to the invention, in contrast to the use of conventional guide plates, it is possible, when the large-area ionic fan configuration is used, to modify the flow strength locally and thus act specifically on the flat products. In the prior art, this can be carried out only by exchanging the guide plate. In this respect, the device according to the invention may advantageously be configured in such a way that it is suitable for acting upon at least part of the surroundings of the flat products with overpressure or underpressure, as compared with the normal atmospheric pressure or ambient pressure, for the purpose of guiding the flat products.

In general, it is possible to use the ionic fans in two different operative directions, so that, for example, they can exert a sucking or blowing action on the print carrier sheets in the direction of these print carriers. Thus, during the above-described guidance of the print carrier sheets while being transported through a sheet-processing machine, it may be advantageous, for example, to act upon the trailing end of the guided print carrier sheet with overpressure, in order to prevent these ends of the print carrier sheets from coming into contact with the blowing device or other guide devices, but it may also be advantageous to act upon a trailing end of a guided print carrier sheet with underpressure. Thus, for example, it is advantageous, during the guidance of the print carrier sheet through the use of a transport cylinder, the front end of the print carrier sheet being retained by transport grippers of the transport cylinder, to suck up and retain the trailing end of the print carrier sheet on the transport cylinder through the use of a generated underpressure and thereby prevent the trailing end from coming into contact with other components in the vicinity of the transport path of the print carrier sheets. In sheet turning devices, too, a print carrier sheet can be guided and turned by adhesion on the turning drum through the use of a generated underpressure. For this purpose, according to the invention, fan units containing ionic fans may be provided within a cylinder or may be integrated into the surface of the latter.

A further device according to the invention is distinguished in that a powder container with at least one feed unit is provided, the feed unit transporting the powder from the powder container into the air stream of the at least one ionic fan. It thus becomes possible also, for example, to apply powder to print carrier sheets via the accurately controllable electrically charged air stream of the ionic fan, uncontrollable powder turbulences advantageously being avoided and the specific local application of powder to the print carrier sheet thereby being possible. In this case, the charged air molecules may serve as carriers for the powder particles which are bound via electrostatic forces to the charged air molecules or are entrained by these likewise via electrostatic forces. Linear or areal, i.e. flat, configurations of powder devices, which are operatively connected to ionic fans, may also be provided according to the invention, with the result that, for example, a linear powder application transversely to the direction of transport of the print carrier sheets or else areal application of powder to these print carrier sheets becomes possible. Due to the controllability of the ionic fans, it is also possible, in addition to the normal continuous powder application, to produce a powder profile and transfer it specifically to the print carrier sheets. What can be achieved thereby is that respective printed zones on a print carrier are acted upon by different powder quantities according to the quantity of their ink or lacquer application. This advantageously leads to a saving of powder for the printer, since this can be adapted exactly to the necessary powder requirement on the print carrier sheet. Moreover, particularly in zones of the print carrier sheet in which no ink has been applied, the powder quantity can be reduced to a minimum or even completely. It is also possible, furthermore, to suck away any excess powder from the surroundings of the print carriers through the use of at least one further fan unit. In this case, the at least one further fan unit, which may likewise include at least one ionic fan, may be provided adjacently to the powder application fan units, or, in the case of a linear or areal configuration of the powder application fan unit, suctioning or vacuuming individual fans or fan groups may also be provided between the applying individual fans of the fan unit. The sucked-away powder may advantageously be introduced again into the powder circuit of the machine processing print carriers, thus resulting in a further cost saving for the printer.

Since a charge can also be transmitted to the flat products through the use of the ionic fans, ionizing strips, which, if appropriate, are present in the duplicating machine for charging the flat products, can advantageously be dispensed with.

According to an advantageous mode of the invention, the powder container, the at least one feed unit and the at least one ionic fan are configured to apply the powder to flat products, such as print carriers and in particular paper sheets and cardboard sheets.

According to another mode of the invention, the at least one ionic fan includes a plurality of individually controllable ionic fans configured to be controlled for a zonal powdering of the flat products. The controllable ionic fans are advantageously configured to be controlled in a direction transverse to the transport direction.

With the objects of the invention in view there is also provided, a duplicating machine configuration, including a duplicating machine, such as a printing machine, including an air stream generator for generating an air stream, and the air stream generator for generating the air stream including at least one fan unit having at least one ionic fan.

With the objects of the invention in view there is further provided, a delivery configuration for a duplicating machine, including a delivery having an air stream generator for generating an air stream, and the air stream generator including at least one fan unit having at least one ionic fan.

With the objects of the invention in view there is also provided, in combination with a duplicating machine, a cylinder configuration, including a cylinder disposed in the duplicating machine, the cylinder having an interior region, and an air stream generator for generating an air stream disposed in the interior region of the cylinder, the air stream generator having at least one fan unit with at least one ionic fan. The duplicating machine may be a rotary offset printing machine.

With the objects of the invention in view there is also provided, a method for guiding flat products in a duplicating machine, the method includes the steps of:

generating a flow field of air streams with a plurality of controllable ionic fans of a fan unit;

guiding flat products, at least in given sections of a duplicating machine, with the flow field of air streams.

In other words, a method according to the invention for guiding flat products, in particular print carriers, in duplicating machines, the flat products being guided at least partially by an air stream, is distinguished in that a flow field is generated, using a fan unit having a number of controllable, in particular individually controllable ionic fans. By the flow field being generated with any desired predeterminable contour, the flat products can advantageously be guided, stabilized, and damage, particularly to their surface, can be prevented. It is also advantageously possible to adapt the flow field in a continuous manner or in steps to the transport conditions in the duplicating machine or to disturbing influences, for example caused by drying devices, for example to the flat products guided past the fan units, in particular to their position in space or even to their presence or absence. Due to the action on the flat products through the use of the number of ionic fans, it is thus possible to ensure that a maximum permissible flapping amplitude of the flexible flat products, which depends inter alia on the weight of the flat products, is maintained.

With the objects of the invention in view there is also provided, a method of depositing flat products in a duplicating machine, the method includes the steps of:

generating a flow field of air streams with a plurality of controllable ionic fans of a fan unit; and at least supporting a depositing of flat products with the flow field of air streams in a duplicating machine.

In other words, a further method according to the invention, which is used when flat products are deposited in duplicating machines, in particular when print carriers are deposited, the depositing of the flat products being at least assisted by an air stream, is distinguished by the generation of a flow field, using a fan unit having a number of controllable, in particular individually controllable ionic fans. When the method according to the invention is used, an advantageously controllable and therefore controlled depositing of flat products, in particular of print carriers, is achieved. By the flow field being generated through the use of the individually controllable ionic fans, the depositing of flat products can be carried out in such a way that a compact deposited pile of sheets without displaced individual sheets is obtained. In this case, it is advantageously possible, for example, by the method according to the invention, to generate a flow field such that the print carriers to be deposited are pressed centrally onto the depositing pile very firmly by the individual flows in a direction transverse to the direction of transport of the print carriers, while the strength of the individual flows is reduced outward in the outer regions. The sheet newly to be deposited is thus pressed onto the depositing pile from the center toward the outer regions, so that an air cushion possibly present under the sheet newly to be deposited can escape, transversely to the direction of transport, from under the print carrier sheet during the depositing operation. Furthermore, the flow field can also be adapted to the material properties of the print carriers or other flat products to be deposited, such as, for example, to their bendability, with the result that, both in the case of very thin and flexible products and in the case of thicker and less bendable flat products, such as for example, board sheets, the depositing can be carried out in a desired way, in a controlled manner and without damage being caused to the flat products.

With the objects of the invention in view there is also provided, a method of powdering print carriers in a duplicating machine, the method includes the steps of:

generating a flow field of air streams with a plurality of controllable ionic fans of a fan unit; and feeding powder to print carriers in a duplicating machine by using the flow field of air streams for performing a zonal powdering of the print carriers.

In other words, a method according to the invention for the zonal powdering of print carriers in duplicating machines, in particular in printing machines, the powder being fed to the print carriers by an air stream, is distinguished by the generation of a flow field, using a fan unit having a number of controllable, in particular individually controllable ionic fans. The method according to the invention makes it possible to carry out the application of powder to the print carriers in a turbulence-free manner and with a locally varying powder feed. As a result, advantageously, even those print orders which have zonally highly fluctuating ink applications can be provided with a zonally varied powder quantity.

Furthermore, it is advantageously possible to combine the methods for guiding or for depositing flat products with the method for powdering print carriers, that is to say to use at least some of the ionic fans, used for guiding and depositing, at the same time for powdering.

In general, it is also possible, in the above-described devices and methods, to activate the individually controllable ionic fans in a configuration of a plurality of ionic fans by computer assistance, in which case preset values for the varying flow strengths of the individual ionic fans can be gathered, for example, from preprepared flow profiles which, for example, are stored. Such flow profiles may have been filed, that is to say stored, for example, for varying print orders, print carriers, varying ink or dampening-medium application or else for varying production-run speeds. However, it is also advantageously possible, furthermore, to calculate the flow profiles from measured printing parameters of a printing machine, such as, for example, a production-run speed of the latter, and to modify the flow profiles during the operation of the duplicating machine. For example, the flow profile of a sheet guide device in the case of an increasing production-run speed can be reinforced as a whole.

With the objects of the invention in view there is also provided, a method of transporting print carriers in a duplicating machine, the method includes the steps of:

generating blast air with at least one ionic fan; and using the blast air for one of transporting and assisting a transport of print carriers at least in one section of a duplicating machine.

Other features which are considered as characteristic for the invention are set forth in the appended claims.

Although the invention is illustrated and described herein as embodied in a device and a method for generating an air stream in a duplicating machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
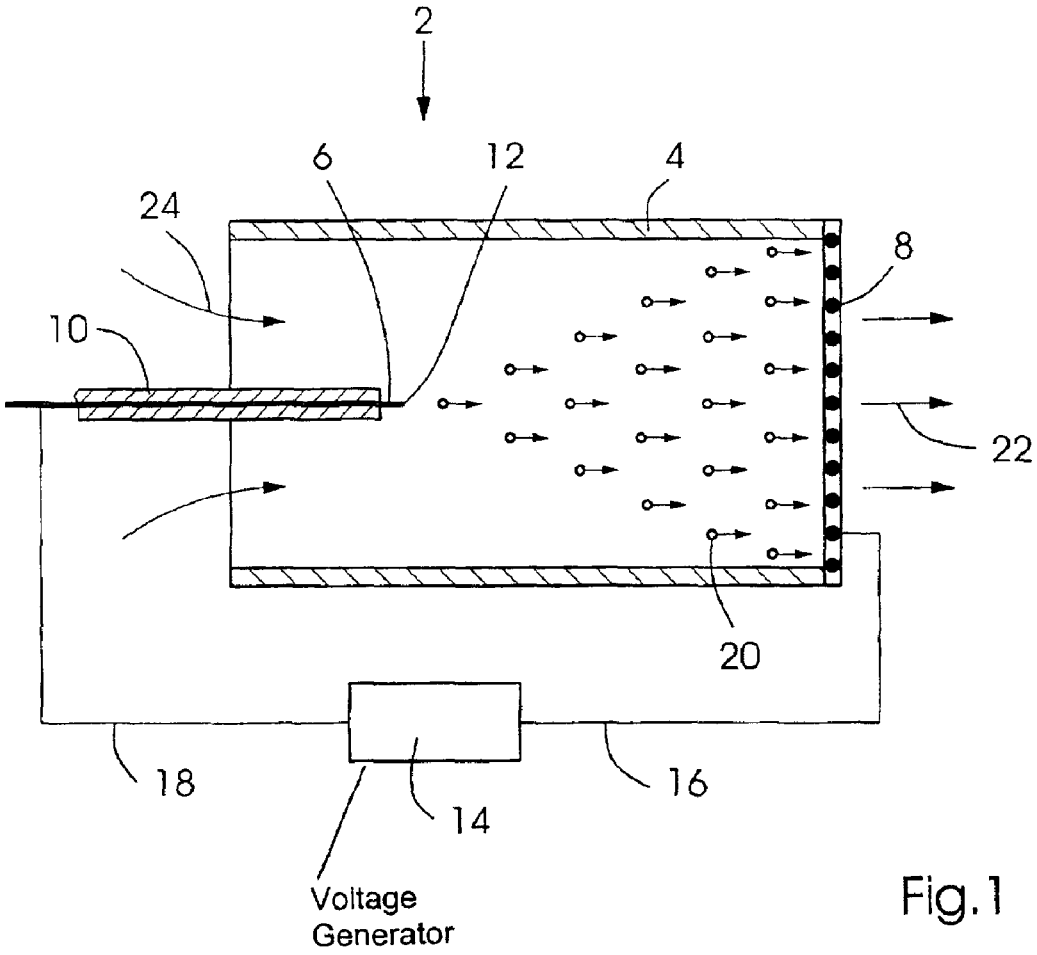
FIG. 1 is a diagrammatic sectional view of an ionic fan according to the invention.

Referring now to the figures of the drawings in detail and first, particularly, to FIG. 1 thereof, there is shown a sectional view, the diagrammatic configuration of an ionic fan 2, the latter being limited outwardly by a nonconductive housing 4 which may be formed, for example, of a glass or a ceramic. The ionic fan 2 is delimited at its front end by a conductive grid 8, while an electrically conductive wire 6 provided with an insulation 10 is positioned at its rear end through the use of fastening arms, which are not illustrated. The insulation 10 likewise may be formed of a glass or a ceramic. Instead of the grid 8, a conductive ring may also be provided at the front end of the ionic fan 2. In the exemplary embodiment shown, a device for generating a voltage 14 is provided, which is connected via a line 18 to the wire 6 and via a line 16 to the grid 8. A voltage or a high voltage, for example of the order of magnitude of about 2 to 3 kV, can thereby be generated between the wire 6 and the grid 8. It is also possible, however, for the grid 8 to be grounded and for the voltage device 14 to be connected only via a line 18 to the wire 6, a voltage thereby being generated at the wire 6 in relation to ground. The applied voltage primarily brings about a discharge at the front end 12 of the wire 6, with the result that, in the vicinity of this end 12, gas ions are generated which undergo acceleration in the direction of the grid 8 in the electrostatic field between the wire 6 and the grid 8. By pulse transmission from the gas ions to nonionized gas atoms or gas molecules 20, these, too, are accelerated in the direction of the grid 8, this giving rise to an air stream through the housing 4 of the ionic fan 2, which leaves the ionic fan 2 as a directed flow 22. An air stream with a range of about 20 cm can thus be generated. Air is thereby sucked into the interior of the ionic fan 2 from outside at a rear end of the ionic fan 2, as indicated by the arrow 24.

It is also conceivable to use only an annular diaphragm as an electrode instead of the grid 8. When a plurality of individually activated annular diaphragms or apertures with different diameters are used, the aperture diameter of the ionic fan can be modified by the selected activation of a specific annular diaphragm and therefore, with the air stream volume remaining the same, the flow velocity can be modified.

Figure 2:
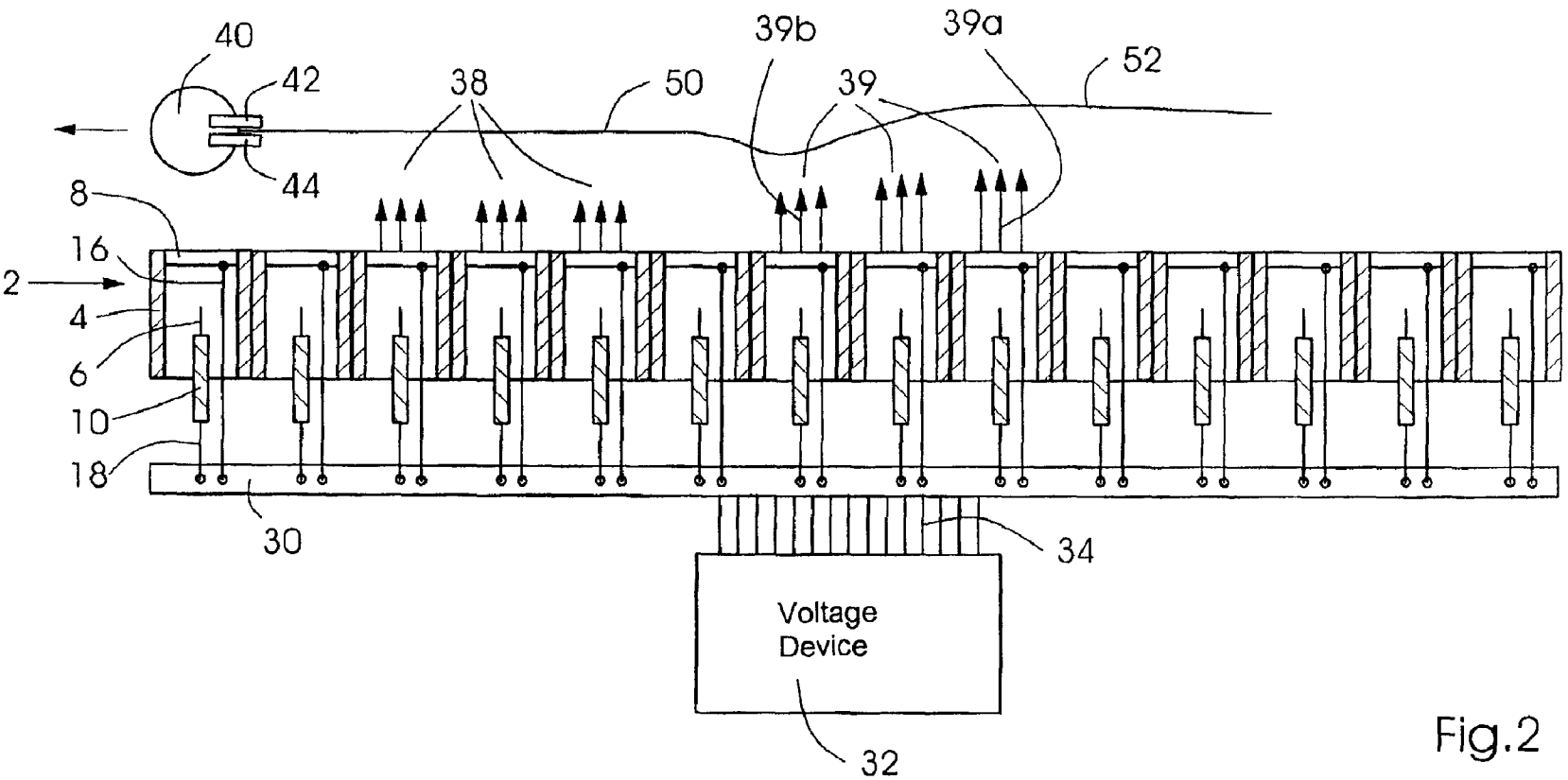
FIG. 2 is a diagrammatic sectional view of a linear configuration of a plurality of ionic fans according to the invention for guiding a print carrier sheet.

FIG. 2 shows a sequence of ionic fans 2 which have a configuration as described in FIG. 1 and are provided closely next to one another. Each individual ionic fan 2 has, in turn, an insulating housing 4 and an insulation 10 and also an electrically conductive grid 8 and an electrically conductive point 6 which are electrically connected to a voltage device 32 in each case via a line 16 and 18, a carrier 30 and further lines 34. Provided on the carrier 30, are conductive connections from the respective lines 16 and 18 of each individual ionic fan 2 to respective lines of the number of lines 34 of the voltage device 32, so that the voltage device can apply a desired voltage or high voltage to selected ionic fans 2 via a control device, which is not illustrated. This voltage can be applied to the ionic fan for a relatively long period of time, but there may also be provision for modifying the voltage in time. Three selected ionic fans 2 generate the same air stream 38 in each case, which is illustrated by the same length and the same number of arrows 38. Three further selected ionic fans 2 generate a locally variable air profile 39 which corresponds to a linear flow field and is illustrated by the different length of the arrows 39. A print carrier sheet 50, which is transported by a transport gripper 40, through the use of gripper fingers 42 and gripper supports 44 attached to it, has, particularly at its freely trailing end 52, a wavy profile which corresponds to the flow profile 39. As may be gathered from FIG. 2, the print carrier sheet 50 can be spaced further away from the ionic fans 2 through the use of a stronger air stream 39*a* and the print carrier sheet 50 can be brought nearer to the ionic fans 2 through the use of a weaker air stream 39*b*. A specific action of the ionic filters 2 on the position of the print carrier sheet 50 is thereby possible. By a detection device, not illustrated, for detecting the position of the print carrier sheet 50 in space, in particular the position of the print carrier sheet in relation to the row of ionic fans 2, position-related measurement values can be transmitted to an integrated control device in the voltage device 32, so that the latter can modify the flow profile 39 of selected ionic fans via a modified voltage in order to correct the position of the print carrier sheet 50.

Figure 3:
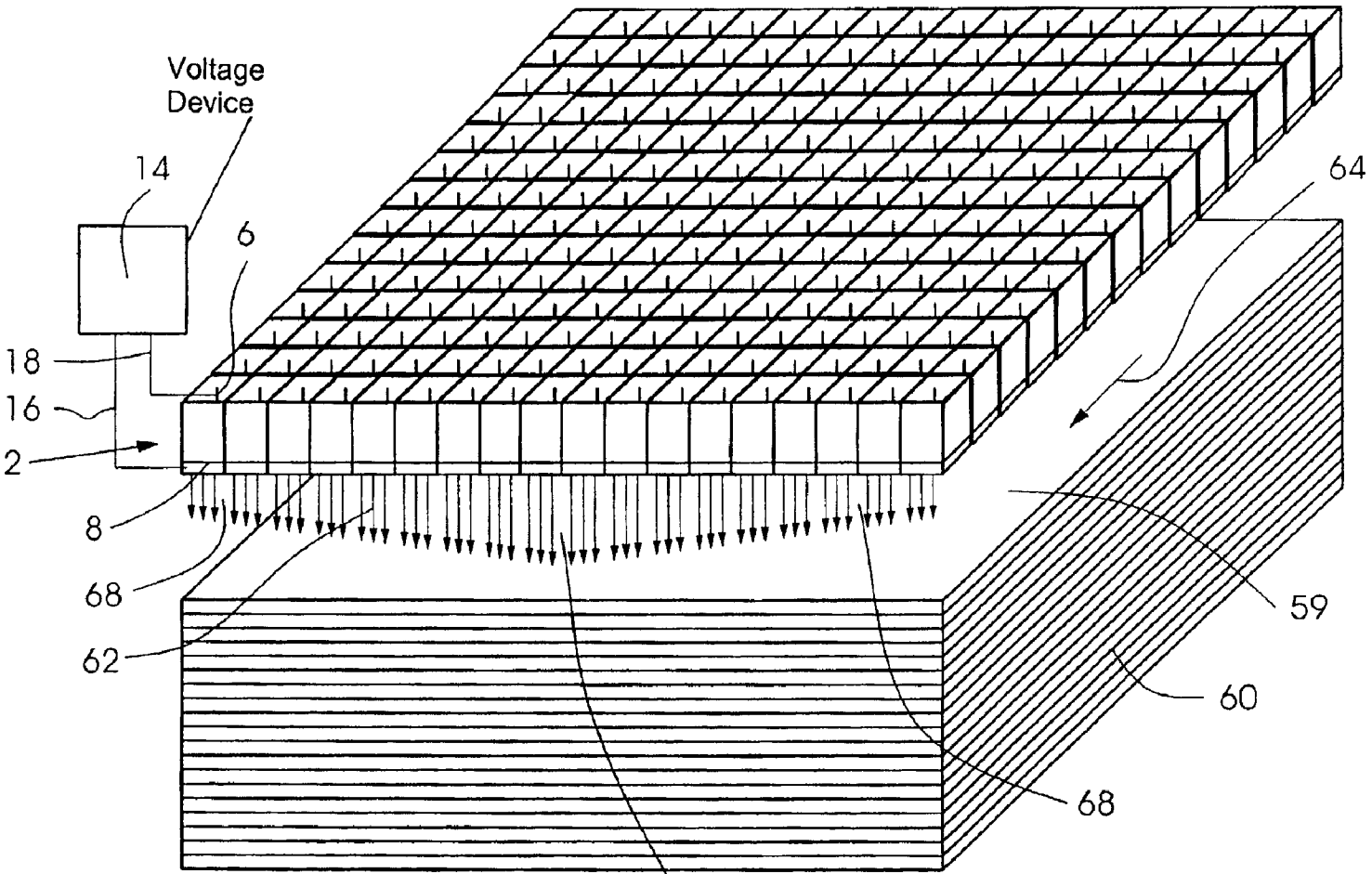
FIG. 3 is a diagrammatic perspective view of a matrix configuration of ionic fans according to the invention in the delivery of a printing machine.

FIG. 3 shows a matrix configuration of ionic fans 2 which all have a conductive outlet orifice, for example in the form of a grid 8 or merely a conductive border of the nonconductive housing and a conductive discharge point 6. The two electrodes 6 and 8 are conductively connected to a voltage device 16 via respective lines 18 and 16. In a similar way to that described in FIG. 2, each individual ionic-fan segment 2 of the matrix configuration can be individually activated by the voltage device 14 via lines and the air flow of each individual segment can be set as a result. It thereby becomes possible to generate a flow profile or a flow field 62 which, as shown in FIG. 3, may, for example, have a V-shape in cross section. A print carrier sheet 59 which is to be deposited on a depositing pile 60 and is fed to the depositing pile 60 in the direction of the arrow 64 is pressed by the flow profile 62 onto the depositing pile 60 more firmly in the center 66 of the flow profile 62 than in the edge regions 68 of the flow profile 62. The air located under the print carrier sheet 59 to be deposited can thereby escape transversely to the direction 64.

Figure 4:
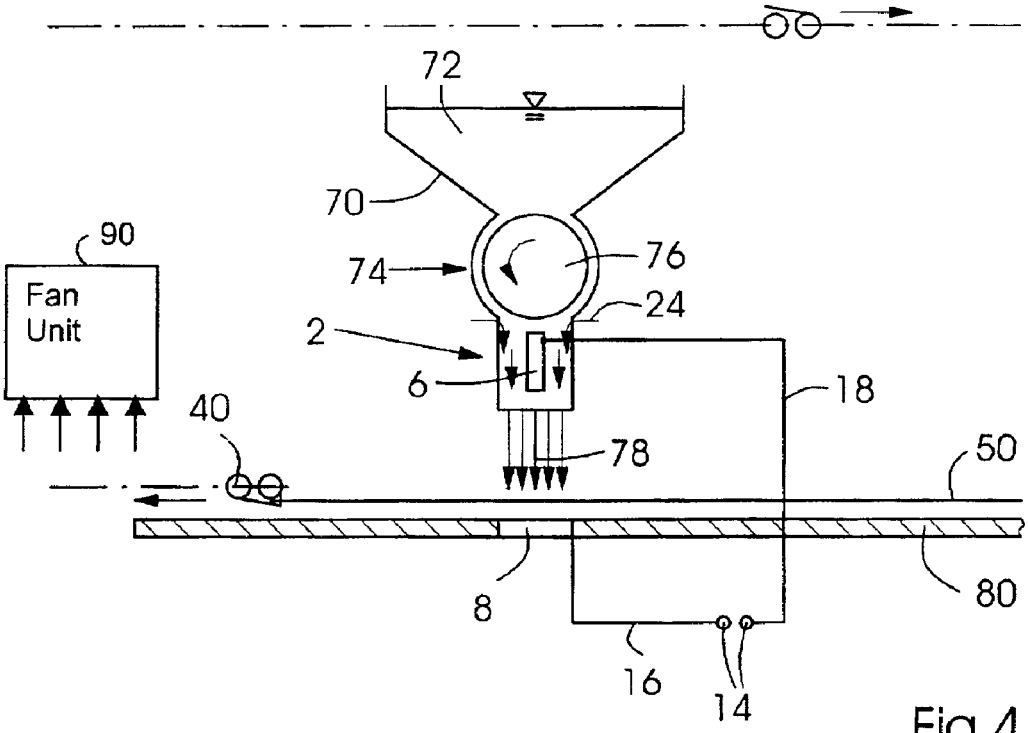
FIG. 4 is a diagrammatic sectional view of a powder device with an ionic fan according to the invention for powdering print carriers.

The powder device shown in FIG. 4 includes an ionic fan 2 having discharge electrodes 6 and 8 which are connected to a voltage device 14 via lines 16 and 18. Also shown are a powder storage container 70 with powder 72 contained therein and a metering device 74 with a metering roller 76. The powder 72 in the storage container 70 is conveyed through a gap between the metering roller 76 and the outer wall of the metering device 74 as a result of the rotation of the metering roller 76 and is fed to the air stream of the ionic fan, thus giving rise to an air/powder mixture 78 which is blown onto a print carrier sheet 50. At the same time, the rotational speed of the metering roller 76 and/or the voltage applied to the ionic fan 2 can be adapted to the machine speed, with the result that speed-compensated powdering becomes possible. The print carrier sheet 50 is, in this case, transported by a transport gripper 40 through the operative region of the powder device and over and beyond a guide device 80. Powder devices of this type may be provided next to one another, transversely to the transport path of the print carrier sheets 50, in a way not illustrated and can thus apply the powder to the print carrier sheet 50 in a zonally meterable manner. A further fan unit 90 configured to suck away excess powder from the print carrier and its surroundings is schematically shown.

Figure 5:
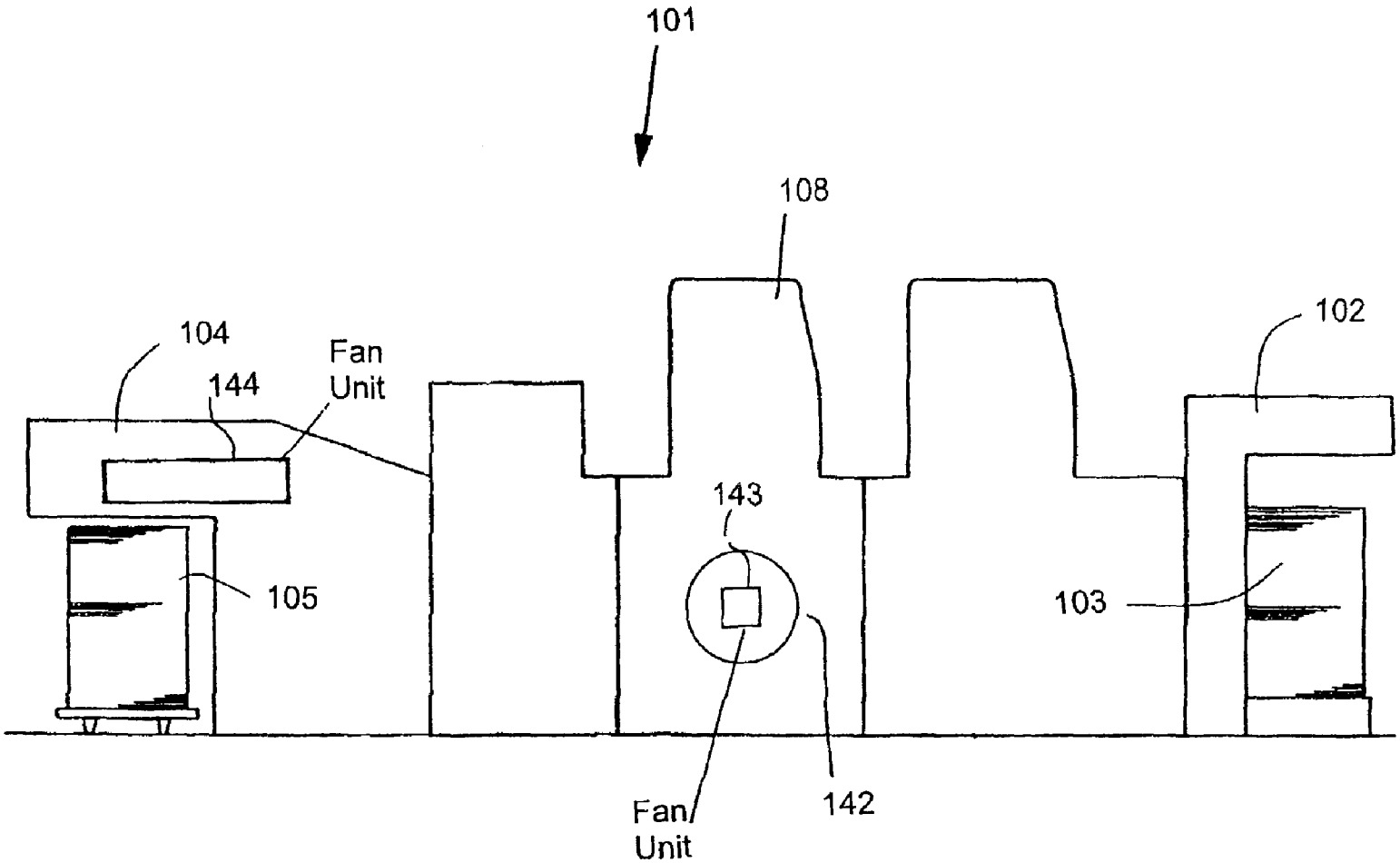
FIG. 5 is a diagrammatic side view of a duplicating machine including ionic fans according to the invention.

FIG. 5 shows, in diagrammatic form, a duplicating machine 101, such as a printing machine, including ionic fans according to the invention. The duplicating machine 101 includes a sheet feeder 102 with a pile of sheets 103 to be processed. A duplicating unit 108 includes a cylinder 142. A fan unit 143 including ionic fans is disposed in an interior region of the cylinder 142. A delivery 104 including a further fan unit 144 deposits the sheets in a delivery pile 105.

We claim:

1. In combination with a duplicating machine, a device for generating an air stream in the duplicating machine, comprising:

at least one fan unit having one of a sequence of ionic fans and a matrix configuration of ionic fans, said ionic fans being supplied with a voltage for generating and accelerating gas ions by a discharge for accelerating non-ionized gas by pulse transmission and generating the air stream, said ionic fans being one of individually controlled and individually regulated by the voltage in order to generate one of a desired flow profile and a desired flow field.

2. The device according to claim 1, wherein said ionic fans are disposed substantially adjacent one another along a given apace curve.

3. The device according to claim 1, wherein said ionic fans are disposed substantially adjacent one another along a straight line.

4. The device according to claim 1, wherein said ionic fans are disposed substantially adjacent one another and spread over a given area.

5. The device according to claim 1, wherein said at least one fan unit is configured to be disposed adjacent a transport path for flat products.

6. The device according to claim 1, wherein said at least one fan unit is configured to be disposed adjacent a transport path for print carriers.

7. The device according to claim 1, wherein said at least one fan unit is configured to be disposed adjacent a transport path for flat products selected from the group consisting of paper sheets and cardboard sheets.

8. The device according to claim 1, wherein said at least one fan unit is configured to be disposed adjacent a transport path for a flat product and said at least one fan unit is configured to act upon at least a part of a region surrounding the flat product with a pressure for guiding the flat product, the pressure is selected from the group consisting of an overpressure as compared to an ambient pressure and an underpressure as compared to the ambient pressure.

9. The device according to claim 1, including:

a powder container for holding powder; and at least one feed unit connected to said powder container and transporting the powder from said powder container into the air stream of said ionic fans.

10. The device according to claim 9, wherein said powder container, said at least on feed unit and said ionic fans are configured to apply the powder to flat products.

11. The device according to claim 9, wherein said powder container, said at least one feed unit and said ionic fans are configured to apply the powder to print carriers selected from the group consisting of paper sheets and cardboard sheets.

12. The device according to claim 10, wherein said ionic fans are configured to be controlled for a zonal powdering of the flat products.

13. The device according to claim 12, wherein the flat products define a transport direction and said ionic fans are configured to be controlled in a direction transverse to the transport direction.

14. The device according to claim 10, wherein said at least one feed unit is a plurality of individually controllable feed units configured to be controlled for a zonal powdering of the flat products.

15. The device according to claim 14, wherein the flat products define a transport direction and said plurality of individually controllable feed units are configured to be controlled in a direction transverse to the transport direction.

16. The device according to claim 10, including at least one further fan unit configured to suck away excess powder from a region surrounding the flat products.

17. The device according to claim 1, wherein the duplicating machine is a printing machine.

18. A duplicating machine configuration, comprising:

a duplicating machine including an air stream generator for generating an air stream; and said air stream generator for generating the air stream including at least one fan unit having one of a sequence of ionic fans and a matrix configuration of ionic fans, said ionic fans being supplied with a voltage for generating and accelerating gas ions by a discharge for accelerating non-ionized gas by pulse transmission and generating the air stream, said ionic fans being one of individually controlled and individually regulated by the voltage in order to generate one of a desired flow profile and a desired flow field.

19. A printing machine configuration, comprising:

a rotary offset printing machine including an air stream generator for generating an air stream; and said air stream generator for generating the air stream including at least one fan unit having one of a sequence of ionic fans and a matrix configuration of ionic fans, said ionic fans being supplied with a voltage for generating and accelerating gas ions by a discharge for accelerating non-ionized gas by pulse transmission and generating the air stream, said ionic fans being one of individually controlled and individually regulated by the voltage in order to generate one of a desired flow profile and a desired flow field.

20. A delivery configuration for a duplicating machine, comprising:

a delivery including an air stream generator for generating an air stream; and said air stream generator including at least one fan unit having one of a sequence of ionic fans and a matrix configuration of ionic fans, said ionic fans being supplied with a voltage for generating and accelerating gas ions by a discharge for accelerating non-ionized gas by pulse transmission and generating the air stream, said ionic fans being one of individually controlled and individually regulated by the voltage in order to generate one of a desired flow profile and a desired flow field.

21. In combination with a duplicating machine, a cylinder configuration, comprising:

a cylinder disposed in the duplicating machine, said cylinder having an interior region;

an air stream generator for generating an air stream disposed in said interior region of said cylinder; and said air stream generator including at least one fan unit having one of a sequence of ionic fans and a matrix configuration of ionic fans, said ionic fans being supplied with a voltage for generating and accelerating gas ions by a discharge for accelerating non-ionized gas by pulse transmission and generating the air stream, said ionic fans being one of individually controlled and individually regulated by the voltage in order to generate one of a desired flow profile and a desired flow field.

22. The cylinder configuration according to claim 21, wherein the duplicating machine is a rotary offset printing machine.

23. A method for guiding flat products in a duplicating machine, the method which comprises:

generating a flow field of air streams with at least one fan unit having one of a sequence of ionic fans and a matrix configuration of ionic fans, the ionic fans being supplied with a voltage for generating and accelerating gas ions by a discharge for accelerating non-ionized gas by pulse transmission and generating an air stream, the ionic fans being one of individually controlled and individually regulated by the voltage in order to generate one of a desired flow profile and a desired flow field; and guiding flat products, at least in given sections of a duplicating machine, with the flow field of air streams.

24. The method according to claim 23, which comprises guiding print carrier as the flat products.

25. The method according to claim 23, which comprises providing individually controllable ionic fans as the controllable ionic fans.

26. A method of depositing flat products in a duplicating machine, the method which comprises:

generating a flow field of air streams with at least one fan, unit having one of a sequence of ionic fans and a matrix configuration of ionic fans, the ionic fans being supplied with a voltage for generating and accelerating gas ions by a discharge for accelerating non-ionized gas by pulse transmission and generating an air stream, the ionic fans being one of individually controlled and individually regulated by the voltage in order to generate one of a desired flow profile and a desired flow field; and at least supporting a depositing of flat products with the flow field of air streams in a duplicating machine.

27. The method according to claim 26, which comprises providing print carriers as the flat products.

28. The method according to claim 26, which comprises providing individually controllable ionic fans as the controllable ionic fans.

29. A method of powdering print carriers in a duplicating machine, the method which comprises:

generating a flow field of air streams with at least one fan unit having one of a sequence of ionic fans and a matrix configuration of ionic fans, the ionic fans being supplied with a voltage for generating and accelerating gas ions by a discharge for accelerating non-ionized gas by pulse transmission and generating an air stream, the ionic fans being one of individually controlled and individually regulated by the voltage in order to generate one of a desired flow profile and a desired flow field; and feeding powder to print carriers in a duplicating machine by using the flow field of air streams for performing a zonal powdering of the print carriers.

30. The method according to claim 29, which comprises providing individually controllable ionic fans as the controllable ionic fans.

31. A method of transporting print carriers in a duplicating machine, the method which comprises:

generating blast air with at least one fan unit having one of a sequence of ionic fans and a matrix configuration of ionic fans, the ionic fans being supplied with a voltage for generating and accelerating gas ions by a discharge for accelerating non-ionized gas by pulse transmission and generating an air stream, the ionic fans being one of individually controlled and individually regulated by the voltage in order to generate one of a desired flow profile and a desired flow field; and using the blast air for one of transporting and assisting a transport of print carriers at least in one section of a duplicating machine.

* * * * *